United States Patent [19]

Chulay et al.

[11] 4,080,175

[45] Mar. 21, 1978

[54] INTERNALLY ACTIVATED SEALING CENTRIFUGE TEST TUBE CAP ASSEMBLY

[75] Inventors: Steven John Chulay, Los Altos; Victor John Grilli, Mountain View, both of Calif.

[73] Assignee: Beckman Instruments, Inc., Fullerton, Calif.

[21] Appl. No.: 788,720

[22] Filed: Apr. 19, 1977

[51] Int. Cl.[2] ..... B04B 15/00

[52] U.S. Cl. ..... 23/292; 233/26

[58] Field of Search ..... 23/259, 292; 233/26

[56] References Cited

U.S. PATENT DOCUMENTS

| | | | |
|---|---|---|---|
| 3,434,615 | 3/1969 | Barletta | 233/26 X |
| 3,447,712 | 6/1969 | Galasso et al. | 220/237 |
| 3,938,735 | 2/1976 | Wright et al. | 233/26 |

*Primary Examiner*—Robert M. Reese

*Attorney, Agent, or Firm*—Robert J. Steinmeyer; Ferd L. Mehlhoff; William H. May

[57] ABSTRACT

A centrifuge test tube cap assembly for sealing a thin walled test tube used primarily with a vertical tube rotor. The cap assembly is designed for convenient and easy removal from the test tube through the use of internal means which activates the direct sealing and unsealing of the cap with respect to the test tube. The mechanism of the tube cap provides for convenient removal of the cap assembly from the test tube which is necessary in order to insert or remove the liquid to be subjected to centrifugation.

7 Claims, 2 Drawing Figures

INTERNALLY ACTIVATED SEALING CENTRIFUGE TEST TUBE CAP ASSEMBLY

BACKGROUND OF THE INVENTION

The present invention is directed to cap assemblies for sealing thin walled test tubes in ultra high speed vertical tube rotor centrifuges. More particularly, the invention is directed to a test tube cap assembly having no central aperture within the cap assembly for insertion or removal of fluid sample being subjected to centrifugation.

As set forth in our concurrently filed patent application Ser. No. 788,484 filed Apr. 18, 1977, entitled A TUBE CAP FOR PREPARATIVE CENTRIFUGE ROTORS, the present test tube cap assembly utilizes the tapered or frustoconical shaped bushing or sealing means for use with the cap assembly. as stated in the above referenced copending patent application, the design of the cap assembly is conducive for use with rotors wherein the hydraulic pressures which are exerted on the tube cap assembly by the liquid within the test tube increase the sealing force of the cap assembly. Consequently, the increased forces placed upon the cap assembly are automatically accommodated by the increased sealing in the cap assembly.

However, in prior cap assemblies a central aperture or channel has been used for the insertion or removal of fluid sample within the test tube. During centrifugation a filler screw is placed within the channel to prevent leakage. However, during high speed centrifugation with a vertical or nearly vertical tube rotor, this central aperture is susceptible to leakage caused by the centrifugation pressures from within the test tube exerted by the fluid sample. The sealing arrangement, as set forth in our copending patent application, is directed primarily to gripping the upper portion of the test tube within the crown member of the cap assembly.

Therefore, it is necessary as a unique problem with respect to vertical or nearly vertical tube rotors to design the cap assembly without the central aperture and yet permit easy removal of the cap assembly with minimum disturbance of the tube contents. The primary purpose for an aperture in the cap assembly is to allow access to within the test tube for removal of the centrifuged sample before actual removal of the cap assembly. Hence, the tube is disturbed as little as possible prior to removal of the centrifuged sample. The practice has been to remove the filler screw in the cap assembly and to allow retrieval of the sample. In some applications it is impractical to extract the tube contents through a small aperture in the cap. Rather, it is desirable to be able to remove the entire cap without disturbing the liquid contents.

If the central aperture is eliminated, it is necessary to remove the complete cap assembly prior to removal of the sample within the test tube. Typically, as shown in our above referenced copending application, the operation of the sealing mechanism utilizes a nut which is tightly secured to an upper end of a stem. The use of such a configuration would undoubtedly result in an undesired disturbance to the test tube centrifugated sample because, after the nut is loosened, the stem would then have to be pushed down into the tube somewhat to break the seal.

Consequently, a need arises with respect to having a cap assembly which does not have a central aperture, but provides an easy removal after centrifugation without disturbing the centrifuged liquid within the test tube.

SUMMARY OF THE INVENTION

The present invention is directed to a unique means within the cap assembly which in cooperation with an exterior tool will allow for the easy and convenient removal of the cap assembly from the test tube without disturbing the sample in the test tube. The present invention utilizes a connector means between the stem and the crown in the cap arrangement which is responsive to an external tool to positively move the stem with respect to the crown in a convenient manner for sealing or unsealing the cap assembly from the test tube.

The important feature of the present invention is that the means connecting the crown with the stem of the cap assembly provides a mechanism for directly moving the stem in either of two opposite directions. The stem can be moved toward or away from the crown to respectively seal or unseal the cap assembly from the tube. Consequently, activation of the connecting means causes a direct movement of the stem in one of two directions. This is different from prior art arrangements where a sealing nut had to first be loosened sufficiently. Then the stem had to be pushed relative to the crown to break the seal on the test tube. The movement of only the connecting means in the present invention results in the direct movement of the stem with respect to the crown. Consequently, this provides for a much easier and convenient one-stem manner in which to unseal or seal the cap to the test tube. Further, it enables the test tube cap to be removed from the test tube with little or no disturbance to the contents in the test tube.

DETAILED DESCRIPTION OF THE INVENTION

Figure 1:
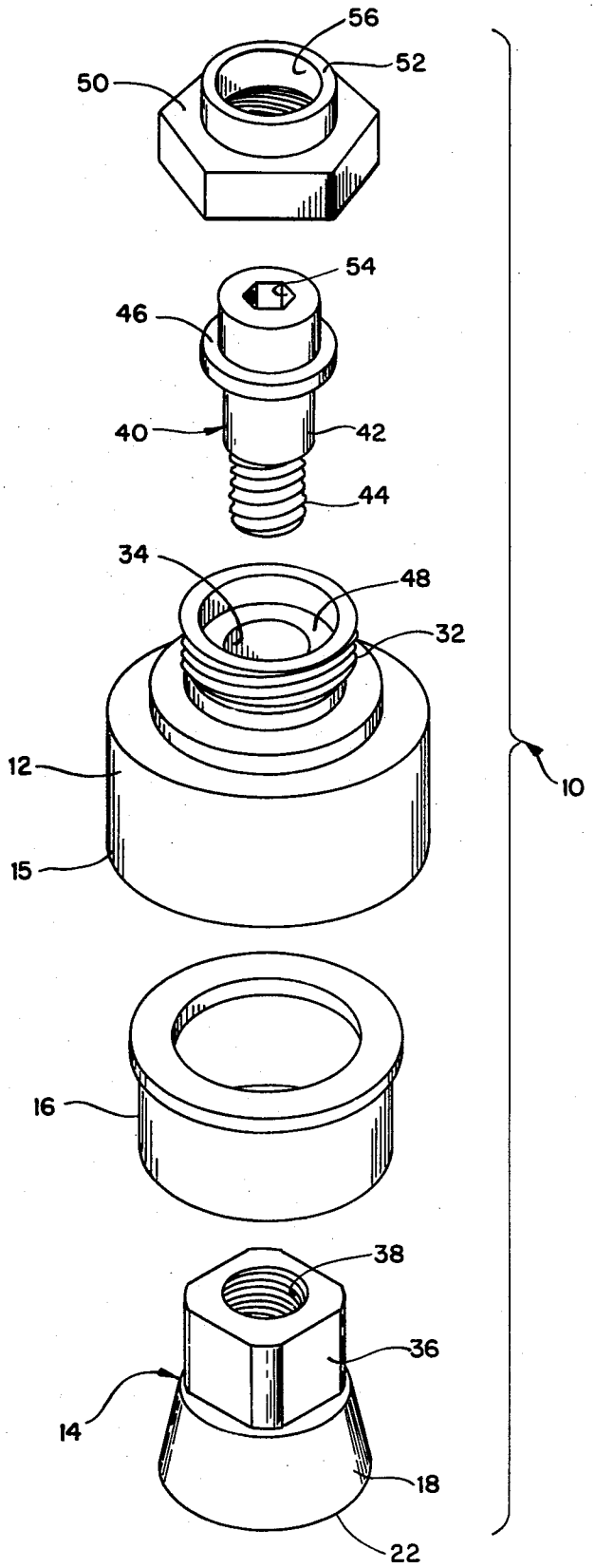
FIG. 1 is an exploded perspective view of the test tube cap assembly of the present invention.

As shown in FIG. 1, the cap assembly 10 has a crown member 12 with a stem 14 for positioning within the crown. Mounted within the skirt 15 of the crown 12 is a bushing 16 which is designed to mate with the frustoconical lower surface 18 of the stem 14. The details with respect to the configuration and operation of the bushing 16 with respect to the crown and stem is explained in more detail in our copending patent application entitled A TUBE CAP FOR PREPARATIVE CENTRIFUGE ROTORS filed concurrently with the present application.

Figure 2:
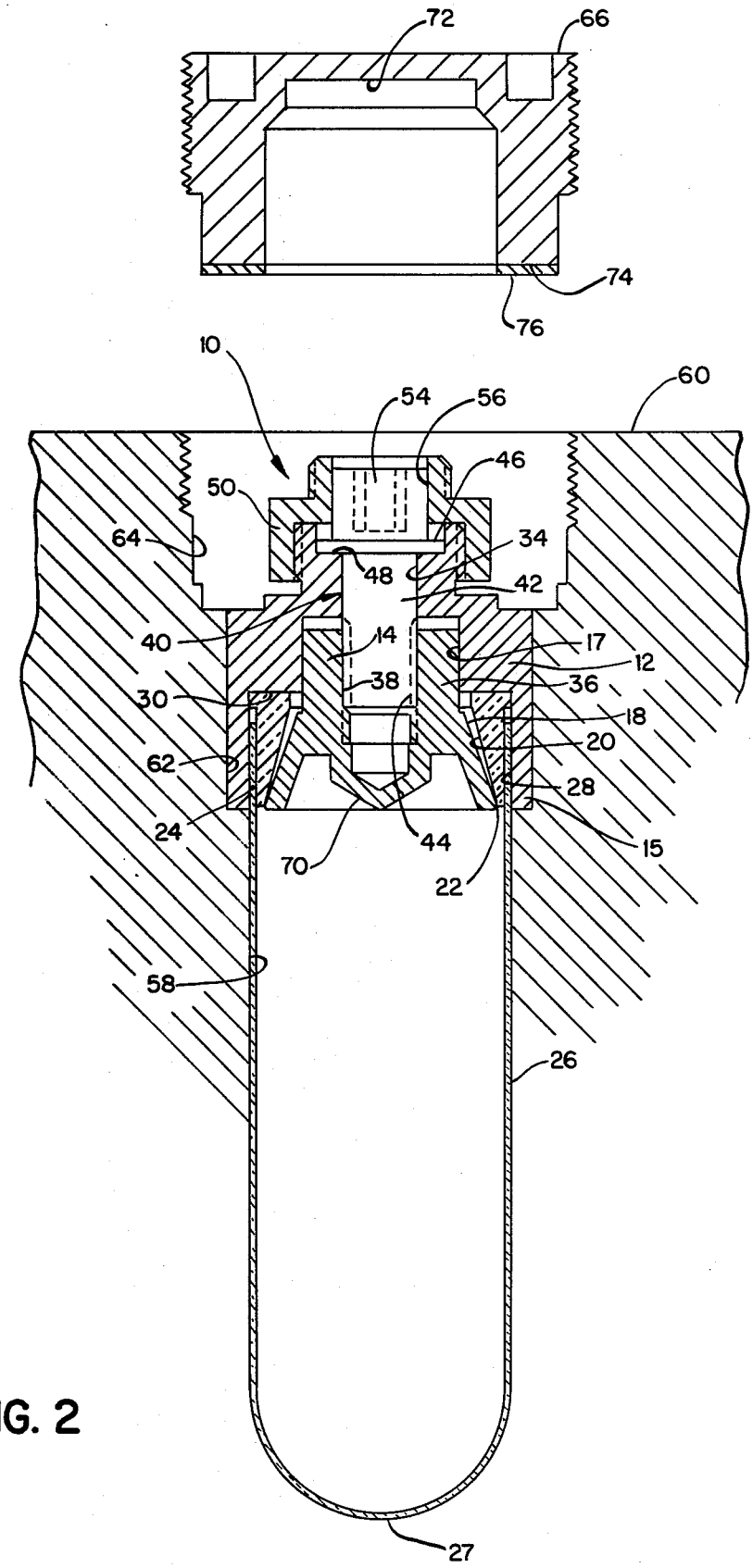
FIG. 2 is a sectional view of the cap assembly mounted on a test tube positioned within a rotor.

As background information, FIG. 2 shows the bushing 16 having an interior frustoconical surface 20 which is designed to receive the outer frustoconical surface 18 of the stem 14. It should be noted that the angle of incline of the frustoconical surface 20 of the bushing 16 is less than the angle of the incline of the surface 18 of the stem 14. Thus, contact between the stem and the bushing is primarily located near the lower edge 22 of the stem 14 to provide the tight seal as the stem 14 is moved in a direction toward the crown 12. The upper portion 24 of the test tube 26 is tightly anchored or pinched between the bushing 16 and the interior surface 28 of the skirt 15 of the crown. The size of the lower portion 18 of the stem 14 designed, so that, when it is in its sealing relationship with the bushing, it is completely within the recess 30 formed by the skirt 15 of the crown.

With respect to FIG. 1, the crown 12 is shown with an upper retaining end 32 and through which is a smooth central opening 34. Located on the upper portion of the stem 14 is an anti-rotational locking head 36, having a threaded aperture 38.

A stem screw 40 is designed to be slidably mounted within the opening 34 in the crown 12. The stem screw has a smooth shank portion 42 for its slidable engagement within the opening 34 in the crown. The lower end of the stem screw 40 is threaded to engage with the threaded aperture 38 in the stem 14. The upper end of the stem screw 40 has a retaining collar 46 which is designed to seat within an open shoulder 48 in the upper portion of the channel 34 of the crown 12. Once the stem screw 40 is positioned within the crown 12, a retaining nut 50 is designed to threadably engage with the threaded upper retaining end 32 of the crown 12. The retaining nut is designed to become locked in engagement with the crown 12. The upper end portion 52 of the retaining nut 50 is necked down to retain the stem screw 40 within the crown 12.

There is no threadable engagement between the stem screw 40 and the crown 12. The stem screw is slidably movable a short distance within the crown 12 and is completely free for axial or rotational movement with respect to the crown 12. It should be noted in the upper end 54 of the stem screw 40 is a recessed area which is exposed through the opening 56 in the retaining nut 50 for receipt of an Allen wrench or similar external tool.

The assembled test tube cap assembly 10 is shown in FIG. 2 engaged with the test tube 26 residing in a test tube cavity 58 within the rotor 60. It should be noted that the test tube cavity 58 has a counterbored area 62 designed to receive the crown member 12. A second counterbore area 64 is designed to receive a plug 66 (shown removed). The threaded plug is positioned in the rotor above the tube cap assembly 10 to retain the cap assembly and tube within the rotor during high speed centrifugation to counter the forces of the fluid sample within the test tube 26. The plug 66 has its interior aperture 72 designed to receive the upper portion of the cap assembly 10. Further the bottom edge 74 of the plug 66 has a secondary sealing gasket 76 designed to prevent escape of any possible leakage from the test tube which may seep along the surface of the cavity 58.

As shown in the assembled arrangement in FIG. 2, the shank portion 42 of the stem screw 40 is slidably engaged with the opening 34 within the crown member 12. The lower portion of the stem screw 44 has a series of threads designed to engage with the threaded open area 38 within the stem 14. The retaining collar 46 in the stem screw 40 is positioned within the shoulder 48 in the crown 12. The placement of the retaining nut 50 over the stem screw 40 and the crown 12 retains the stem screw within the crown, because the opening 56 in the upper portion of the retaining nut 50 has a diameter less than the diameter of the retaining collar 46.

Movement of the stem screw 40, when it is threadably engaged with the stem 14, will result in a relative movement of the stem 14 with respect to the crown 12. The anti-rotation head 36 of the stem 14 is designed to be received within a similarly configured opening 17 within the crown 12. Consequently, when the stem screw 40 is threadably engaging with the stem 14, there will be no relative movement in a rotational direction between the stem 14 and the crown 12. With typical threads on the lower end 44 of the stem screw 40 and in the opening 38 within the stem 14, clockwise motion of the stem screw 40 will result in movement of the stem 14 in a direction away from the bottom 27 of the test tube, establishing a tight seal of the test tube 26 between the bushing 16 and the skirt 15. Movement of the stem screw 40 in a counterclockwise direction will result in the movement of the stem 14 in a direction toward the bottom 27 of the test tube, resulting in an unsealing of the upper portion 24 of the test tube from the bushing 16 and crown 12. Direct movement of the stem screw 40 results in a direct sealing or unsealing of the cap assembly 10 with respect to the test tube 26. In other words, the rotational or axial movement of the stem screw 40 will result in a direct downward or upward movement of the stem member 14 with respect to FIG. 2.

It is envisioned that in order to avoid any disturbing movement with respect to the centrifuged constituents within the test tube 26 after a centrifugation run, a special tool can be utilized that would anchor the cap or retaining nut 50 to hold the cap assembly 10 stationary while rotational movement of the stem screw can be accomplished through the use of an Allen wrench or similar type of tool. Possibly a single tool of some type could be utilized that would both provide a gripping or holding force on the retaining nut 50 while allowing some type of control to move the stem screw 40 to provide the sealing or unsealing motion necessary to either secure or remove the cap from the test tube.

In normal operation of the present invention, the fluid sample to be centrifuged will be placed within the interior of the test tube 26 followed by the placement of the test tube cap assembly 10 on the upper portion 24 of the test tube. The stem screw 40 would then be turned in a clockwise direction to draw the stem 14 up within the skirt 15 of the crown 12 in FIG. 2 causing the lower edge 22 of the stem to push against the bushing 16 and pinch the upper portion 24 of the test tube against the inner wall 28 of the skirt 15. The entire assembly of the test tube cap 10 and the test tube 26 is placed within the cavity 58 of the rotor 60. The retaining plug 66 is then threadably engaged within the counterbore area 64 of the rotor above the test tube cap assembly 10.

It should be noted that the present test tube cap assembly is designed for particular use with vertical tube rotors. The fluid sample within the test tube will exert a significant amount of upward hydraulic forces against the stem member 14. However, as explained in our above referenced copending application, the upward force on the stem will tend to increase the tightness of the seal, because of the wedging action of the lower end 18 of the stem against the bushing 16. Since the entire bottom surface 70 of the stem member 14 is enclosed with no opening for access to the interior of the test tube, leakage during the centrifugation operation is significantly reduced. In prior art arrangements a central or access aperture to the interior of the test tube is a source of leakage even though a stem filling screw is used.

After the centrifugation run is completed, the retaining plug 66 is removed. The cap assembly and the test tube 26 are then carefully removed from the rotor 60 and placed within a carriage or holder of some type. The stem screw is turned two or three rotations in a counterclockwise direction to move the stem 14 in a direction toward the bottom 27 of the test tube. This will result in an unsealing of the cap assembly from the test tube. The cap assembly 10 is then carefully removed from the test tube 26 to allow access to the undisturbed centrifuged material within the test tube. In some instances it may be desirable to remove the test tube cap assembly from the test tube while it still remains within the rotor 60.

It should be noted that, since the upper face of collar 46 on screw 40 contacts the nut 50 during loosening of the cap, it is preferable to make thread 32 connecting the crown and nut a left-handed thread, thereby tending to cause the nut to tighten when the cap is being removed.

What is claimed is:

1. A centrifuge test tube cap assembly for a thin test tube used within a rotor, said assembly comprising:

a crown member;

a cylindrical skirt extending down from the lower side of said crown member;

a stem member having an upper end movably mounted within said crown member and having an enlarged lower end positioned generally within said cylindrical skirt, the upper end portion of said test tube being positioned between said lower end of said stem member and said skirt, said stem member when moved in a first direction forcing said lower end to secure said upper end portion of said test tube against the interior surface of said skirt, said stem when moved in a second direction releasing said lower end from said upper end portion of said test tube to allow removal of said cap assembly from said test tube; and means connecting said crown member and said stem member for directly moving said stem member relative said crown member in one of said first and second directions to allow removal of said cap assembly while said test tube is within said rotor.

2. A centrifuge test tube cap assembly as defined in claim 1 wherein said lower end of said stem member is frustoconical.

3. A centrifuge test tube cap assembly as defined in claim 1 and additionally comprising a bushing located between said lower end of said stem member and said skirt, said bushing being biased against said upper end of said test tube by said lower end of said stem forcing said bushing securely against said skirt when said stem moves in said first direction.

4. A centrifuge test tube cap assembly as defined in claim 2 wherein said lower end of said stem member is frustoconical and said bushing has a frustoconical interior surface.

5. A centrifuge test tube cap assembly as defined in claim 1 wherein said moving means comprises a stem screw slidably retained in said crown member and threadably engaged with said stem member.

6. A centrifuge test tube cap assembly as defined in claim 5 wherein said stem screw contains means for receiving an external control member to move said stem screw.

7. A centrifuge test tube cap assembly for a thin test tube used within a centrifuge rotor, said assembly comprising:

a generally cylindrical crown member having a noncylindrical lower recessed cavity;

a cylindrical skirt depending from the lower end of said crown member;

a stem member having a noncylindrical upper end movably mounted within said recessed cavity of said crown member and having a frustoconical lower end;

a bushing positioned around said lower end of said stem member and having a frustoconical interior surface;

a stem screw centrally and slidably retained within said crown member, said screw extending down into threadable engagement with said stem member, movement of said screw in a first direction causing a directly responsive movement of said stem away from the bottom of said test tube to force said bushing to expand outward against said test tube and secure it against the interior surface of said skirt, movement of said screw in a second direction causing a directly responsive movement of said stem toward said bottom of said test tube to release said force on said bushing to permit removal of said cap assembly from said test tube.

* * * * *

UNITED STATES PATENT AND TRADEMARK OFFICE

CERTIFICATE OF CORRECTION

PATENT NO. : 4,080,175

DATED : March 21, 1978

INVENTOR(S) : Chulay et al.

It is certified that error appears in the above-identified patent and that said Letters Patent are hereby corrected as shown below:

Claim 4, line 4, after "claim" delete "2" and insert --3--.

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*